US006684130B2

(12) United States Patent
Ogure et al.

(10) Patent No.: US 6,684,130 B2
(45) Date of Patent: Jan. 27, 2004

(54) ROBOT APPARATUS AND ITS CONTROL METHOD

(75) Inventors: Satoko Ogure, Tokyo (JP); Hideki Noma, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/149,315

(22) PCT Filed: Oct. 11, 2001

(86) PCT No.: PCT/JP01/08922

§ 371 (c)(1),
(2), (4) Date: Jun. 7, 2002

(87) PCT Pub. No.: WO02/30628

PCT Pub. Date: Apr. 18, 2002

(65) Prior Publication Data

US 2002/0183896 A1 Dec. 5, 2002

(30) Foreign Application Priority Data

Oct. 11, 2000 (JP) ..... 2000-350274
Nov. 30, 2000 (JP) ..... 2000-366201

(51) Int. Cl.[7] ..... G06F 19/00

(52) U.S. Cl. ..... 700/245; 700/213; 700/249; 700/247; 700/253; 700/259; 700/261; 396/165; 396/176; 396/312; 396/283; 396/293; 396/319; 396/335; 348/231.4; 352/27; 318/568.1

(58) Field of Search ..... 316/568.1; 100/245, 100/213, 259, 261, 247, 249, 253; 396/52, 165, 176, 312, 283, 93, 335, 319; 348/231.4, 372, 349, 231.99, 231.6; 352/27, 29, 30; 430/30

(56) References Cited

U.S. PATENT DOCUMENTS 4,459,008 A * 7/1984 Shimizu et al. ..... 396/264
5,134,433 A * 7/1992 Takami et al. ..... 396/165
6,385,506 B1 * 5/2002 Hasegawa et al. ..... 700/245

FOREIGN PATENT DOCUMENTS

| | | | |
|---|---|---|---|
| JP | 54-21331 | | 2/1979 |
| JP | 62-213785 | | 9/1987 |
| JP | 3-162075 | | 7/1991 |
| JP | 10-31265 | | 2/1998 |
| JP | 2000-210886 | | 8/2000 |
| JP | 2000231145 | * | 8/2000 |

OTHER PUBLICATIONS

Olympus D–450, Olympus D–450 Digital Camera, 1999, Internet, pp. 1–12.*

Sivic, Robot navigation using panoramic camera, 1998, Internet, pp. 12.*

Maxwell et al., Alfred: The robot waiter who remembers you, 1999, Internet, pp. 1–12.*

Thrum et al., Probabilistic algorithms and the interactive museum tour–guide robot Minerva, 2000, Internet, pp. 1–35.*

* cited by examiner

*Primary Examiner*—William A. Cuchlinski, Jr.
*Assistant Examiner*—McDieunel Marc
(74) *Attorney, Agent, or Firm*—Frommer Lawrence & Haug LLP; William S. Frommer; Gordon Kessler

(57) ABSTRACT

A robot apparatus is provided with a photographing device for photographing subjects and a notifying device for making an advance notice of photographing with the photographing device. In addition, in a control method for the robot apparatus, an advance notice of photographing subjects is made and then photographs of the subjects are taken. As a result, a picture can be prevented from being taken by stealth, regardless of user's intention, and thus the user's privacy can be protected.

13 Claims, 14 Drawing Sheets

| | | INPUT EVENT NAME | DATA NAME | DATA RANGE | TRANSITION PROBABILITY TO OTHER NODES | | | | |
|---|---|---|---|---|---|---|---|---|---|
| | node 100 | | | | A | B | C | D | n |
| TRANSITION DESTINATION NODE | | | | | node 120 | node120 | node 1000 | | node 600 |
| OUTPUT BEHAVIOR | | | | | ACTION 1 | ACTION 2 | MOVE BACK | | ACTION 4 |
| | 1 | BALL | SIZE | 0, 1000 | 30% | | | | |
| | 2 | PAT | | | | 40% | | | |
| | 3 | HIT | | | | 20% | | | |
| | 4 | MOTION | | | | | 50% | | |
| | 5 | OBSTACLE | DISTANCE | 0, 100 | | | 100% | | |
| | 6 | | JOY | 50, 100 | | | | | |
| | 7 | | SUPRISE | 50, 100 | | | | | |
| | 8 | | SADNESS | 50, 100 | | | | | |
| | | | | | | | | | |

50

FIG. 7

ROBOT APPARATUS AND ITS CONTROL METHOD

TECHNICAL FIELD

This invention relates to a robot apparatus and control method for the same, and for example, more particularly, is suitably applied to a pet robot.

BACKGROUND ART

A four-legged walking pet robot which acts according to commands from a user and surrounding environments has been proposed and developed by the applicant of this invention. This type of pet robot looks like a dog or cat which is kept in a general household, and autonomously acts according to commands from a user and surrounding environments. Note that, a group of actions is defined as behavior which is used in this description.

By the way, such case would possibly occur that if a user feels strong affection for a pet robot, he/she may want to leave pictures of scenes the pet robot usually sees or of memory scenes the pet robot has during growing up.

Therefore, it is considerable that if the pet robot had a camera device on its head and occasionally took pictures of scenes which the pet robot actually saw, the user could feel more satisfied and familiar from the pictures of the scenes or the scenes displayed on a monitor of a personal computer as "picture diary" even if the pet robot was away from the user in the future.

However, if a malevolent user uses such camera-integrated pet robot as a stealthily photographing device to see someone or someone's privacy by stealth, this must cause a big trouble to the targeted person.

On the other hand, even if a honest user, who keeps instructions, stores video data as photographing results into a storage medium installed in the pet robot, the video data may be taken out from the storage medium and drained when the pet robot is away from the user, for example, when he/she has the pet robot fixed or gives it to another person.

Therefore, if a method of creating "picture diary" by using a pet robot having such camera function can be realized under necessary condition in which another person's and own privacy is protected, the user can feel more satisfied and familiar and entertainment property can be improved.

DESCRIPTION OF THE INVENTION

In view of the foregoing, a subject of this invention is to provide a robot apparatus and a control method for the same which can improve entertainment property.

The foregoing object and other objects of the invention have been achieved by the provision of a robot apparatus comprising a photographing means for photographing a subject and a notifying means for making a notice of taking a picture with the photographing means. As a result, the robot apparatus can inform a user that it will take a picture soon, in real time. Thus, which can prevent stealthily photographing, regardless of user's intentions, in order to protect user's privacy.

Further, the present invention provides a control method for the robot apparatus comprising a first step of making a notice of taking a picture of a subject and a second step of photographing the subject. As a result, the control method for the robot apparatus can inform the user that a photograph will be taken soon, in real time. Thus, which can prevent stealthily photographing, regardless of user's intentions, in order to protect user's privacy.

BRIEF DESCRIPTION OF THE DRAWINGS

FIG. 7 is a conceptual diagram showing a state transition table;

BEST MODE FOR CARRYING OUT THE INVENTION

Preferred embodiments of this invention will be described with reference to the accompanying drawings:

(1) Structure of Pet Robot 1 According to the Present Invention

Figure 1:
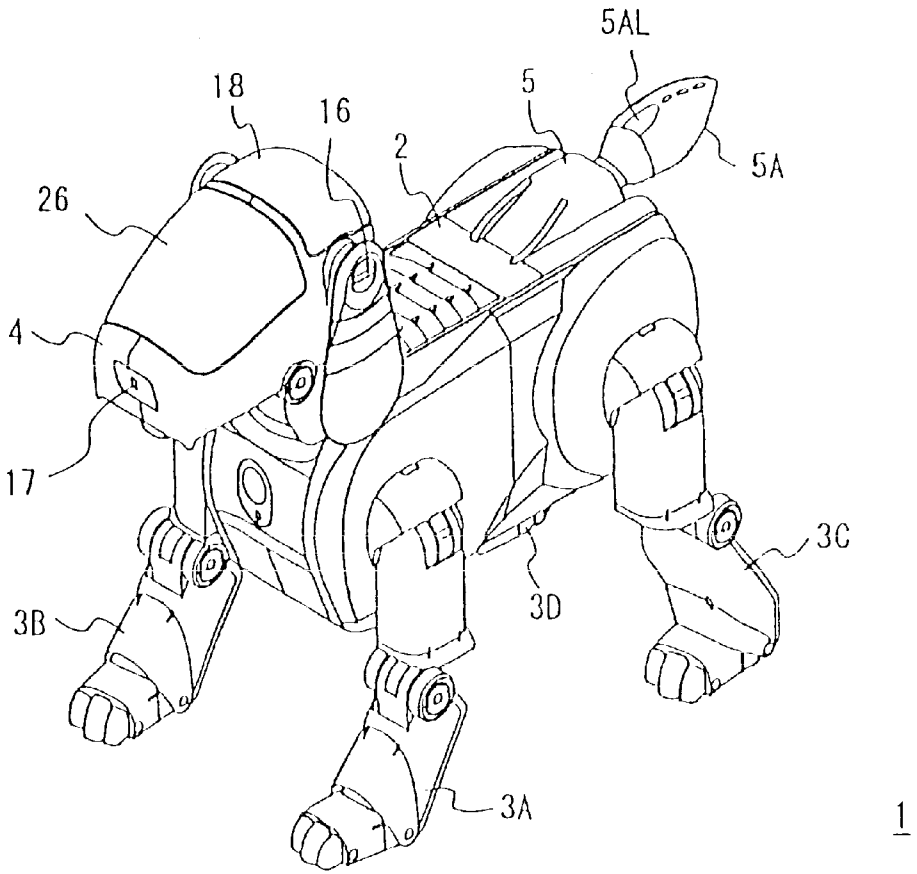
FIG. 1 is a perspective view showing an outward configuration of a pet robot to which this invention is applied.

Referring to FIG. 1, reference numeral 1 shows a pet robot according to the present invention, which is formed by jointing leg units 3A to 3D to the font-left, front-light, rear-left and front-right parts of a body unit 2 and jointing a head unit 4 and a tail unit 5 to the front end and the rear end of the body unit 2.

Figure 2:
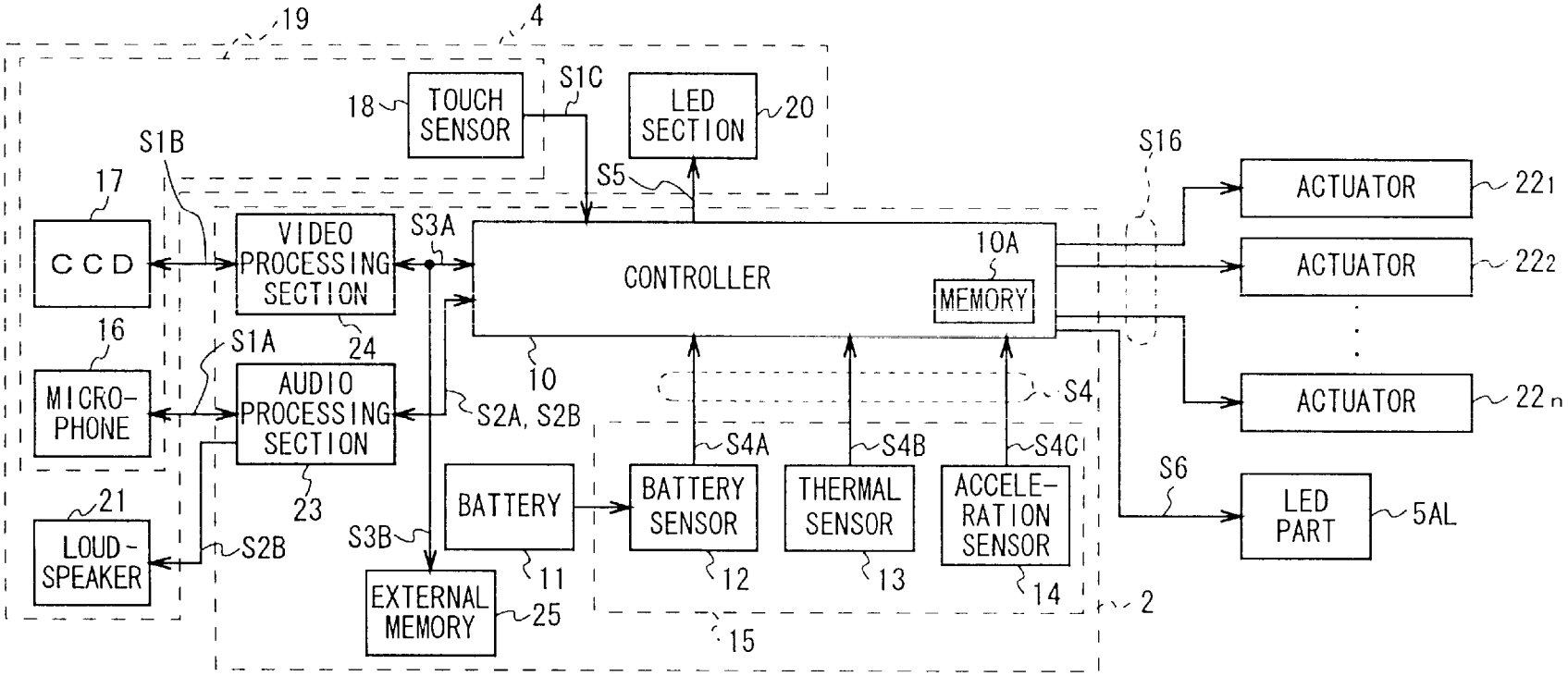
FIG. 2 is a block diagram showing a circuit structure of the pet robot.

In this case, the body unit 2, as shown in FIG. 2, contains a controller 10 for controlling the whole operation of the pet robot 1, a battery 11 serving as a power source 1 of the pet robot, and an internal sensor section 15 including a battery sensor 12, a thermal sensor 13 and an acceleration sensor 14.

In addition, the head unit 4 has an external sensor 19 including a microphone 16 which corresponds to the "ears" of the pet robot 1, a CCD (charge coupled device) camera 17 which corresponds to the "eyes" and a touch sensor 18, an LED (light emitting diode) section 20 composed of a plurality of LEDs which function as apparent "eyes", and a loudspeaker 21 which functions as a real "mouth", at respective positions.

Further, the tail unit 5 is provided with a movable tail 5A which has an LED (hereinafter, referred to as a mental state display LED) 5AL which can emit blue and orange light to show the mental state of the pet robot 1.

Furthermore, actuators $22_1$ to $22_n$ having the degree of freedom are attached to the jointing parts of the leg units 3A to 3D, the connecting parts of leg units 3A to 3D and the body unit 2, the contacting part of the head unit 4 and the body unit 2, and the joint part of the tail 5A of the tail unit 5, and each degree of freedom is set to be suitable for the corresponding attached part.

Furthermore, the microphone 16 of the external sensor unit 19 collects external sounds including words which are given from a user, command sounds such as "walk", "lie down" and "chase a ball" which are given from a user with a sound commander not shown, by scales, music and sounds. Then, the microphone 16 outputs the obtained collected audio signal S1A to an audio processing section 23.

The audio processing section 23 recognizes based on the collected audio signal S1A, which is supplied from the microphone 16, the meanings of words or the like collected via the microphone 16, and outputs the recognition result as an audio signal S2A to the controller 10. The audio processing section 23 generates synthesized sounds under the control of controller 10 and outputs them as an audio signal S2B to the loudspeaker 21.

On the other hand, the CCD camera 17 of the external sensor section 19 photographs its surroundings and transmits the obtained video signal S1B to a video processing section 24. The video processing section 24 recognizes the surroundings, which are taken with the CCD camera 17, based on the video signal S1B, which is obtained from the CCD camera 17.

Further, the video processing section 24 performs predetermined signal processing on the video signal S3A from the CCD camera 17 under the control of controller 10, and stores the obtained video signal S3B in an external memory 25. The external memory 25 is a removable storage medium installed in the body unit 2.

In this embodiment, the external memory 25 can be used to store data in and read data out from, with an ordinary personal computer (not shown) A user previously installs predetermined application software in his own personal computer, freely determines whether to set the photographing function, described later, active or not, by putting up/down a flag, and then stores this setting of putting up/down the flag, into the external memory 25.

Furthermore, the touch sensor 18 is placed on the top of the head unit 4, as can be seen from FIG. 1, to detect pressure obtained by physical spurs such as "stroke" and "hit" by a user and outputs the detection result as a pressure detection signal S1C to the controller 10.

On the other hand, the battery sensor 12 of the internal sensor section 15 detects the level of the battery 11 and outputs the detection result as a battery level detection signal S4A to the controller 10. The thermal sensor 13 detects the internal temperature of the pet robot 1 and outputs the detection result as a temperature detection signal S4B to the controller 10. The acceleration sensor 14 detects the acceleration in the three axes (X axis, Y axis and Z axis) and outputs the detection result as an acceleration detection signal S4C to the controller 10.

The controller 10 judges the surroundings and internal state of the pet robot 1, commands from a user, the presence or absence of spurs from the user, based on the video signal S1B, audio signal S1A and pressure detection signal S1C (hereinafter, referred to as an external sensor signal S1 altogether) which are respectively supplied from the CCD camera 17, the microphone 16 and the touch sensor 18 of the external sensor section 19, and the battery level detection signal S4A, the temperature detection signal S4B and the acceleration detection signal S4C (hereinafter, referred to as an internal sensor signal S4 altogether) which are respectively supplied from the battery sensor 12, the thermal sensor 13 and the acceleration sensor 14 of the internal sensor section 15.

Then the controller 10 determines next behavior based on the judgement result and the control program previously stored in the memory 10A, and drives necessary actuators $22_1$ to $22_n$ based on the determination result to move the head unit 4 up, down, right and left, move the tail 5A of the tail unit 5, or move the leg units 3A to 3D to walk.

At this point, the controller 10 outputs the predetermined audio signal S2B to the loudspeaker 21 when occasions arise, to output sounds based on the audio signal S2B to outside, outputs an LED driving signal S5 to the LED section 20 serving as the apparent "eyes", to emit light in a predetermined lighting pattern based on the judgement result, and/or outputs an LED driving signal S6 to the mental state display LED 5AL of the tail unit 5 to emit light in a lighting pattern according to the mental state.

As described above, the pet robot 1 can autonomously behave based on its surroundings and internal state, commands from a user, and the presence and absence of spurs from a user.

Figure 3:
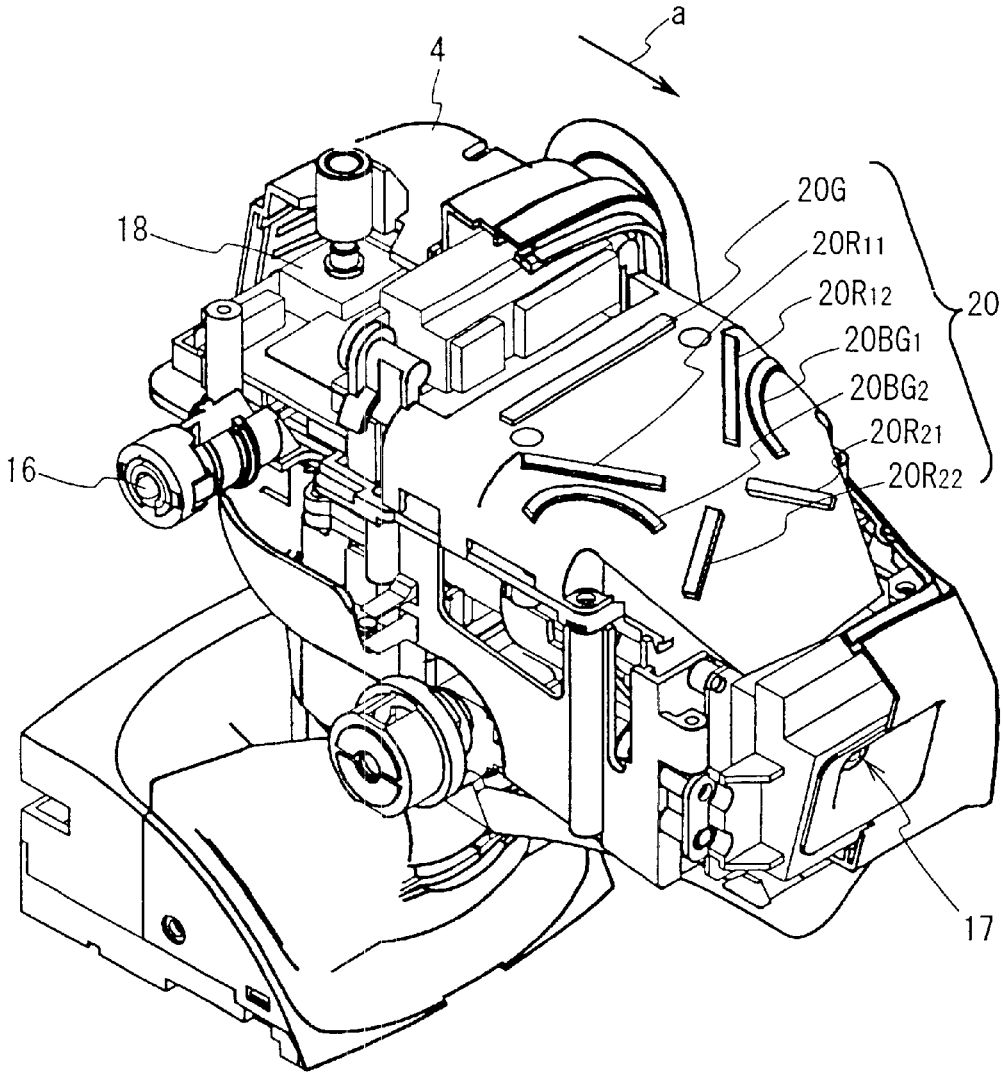
FIG. 3 is a partly cross-sectional diagram showing the construction of a LED section.

FIG. 3 shows a specific construction of the LED section 20 having a function of "eyes" of the pet robot 1 in appearance. As can be seen from FIG. 3, the LED section 20 has a pair of first red LEDs $\mathbf{20}R_{11}$ and $\mathbf{20}R_{12}$ and a pair of second red LEDs $\mathbf{20}R_{21}$ and $\mathbf{20}R_{22}$ which emit red light, and a pair of blue-green light LEDs $\mathbf{20}BG_1$ and $\mathbf{20}BG_2$ which emit blue-green light, as LEDs for expressing emotions.

In this embodiment, each first red LED $\mathbf{20}R_{11}$, $\mathbf{20}R_{12}$ has a straight emitting part of a fixed length and they are arranged tapering in the front direction of the head unit 4 shown by the arrow a, at an approximately middle position in the front-rear direction of the head unit 4.

Further, each second red LED $\mathbf{20}R_{21}$, $\mathbf{20}R_{22}$ has a straight emitting part of a fixed length and they are arranged tapering in the rear direction of the head unit 4 at the middle of the head unit 4, so that these LEDs and the first red LEDs $\mathbf{20}R_{11}$, $\mathbf{20}R_{12}$ are radially arranged.

As a result, the pet robot 1 simultaneously lights the first red LEDs $\mathbf{20}R_{11}$ and $\mathbf{20}R_{12}$ so as to express "angry" as if it feels angry with its eyes turned up or to express "hate" as if it feels hate, simultaneously lights the second red LEDs $\mathbf{20}R_{12}$ and $\mathbf{20}R_{22}$ so as to express "sadness" as if it feels sad, or further, simultaneously all of the first and second red LEDs $\mathbf{20}R_{11}$, $\mathbf{20}R_{12}$, $\mathbf{20}R_{21}$ and $\mathbf{20}R_{22}$ so as to express "horrify" as if it feels horrified or to express "surprise" as if it feels surprised.

On the contrary, each blue-green LED $\mathbf{20}BG_1$, $\mathbf{20}BG_2$ is a curved arrow-shaped emitting part of a predetermined length and they are arranged with the inside of the curve directing the front (the arrow a), under the corresponding first red LED $\mathbf{20}R_{11}$, $\mathbf{20}R_{12}$ on the head unit 4.

As a result, the pet robot 1 simultaneously lights the blue-green LEDs $\mathbf{20}BG_1$ and $\mathbf{20}BG_2$ so as to express "joyful" as if it smiles.

In addition, in the pet robot 1, a black translucent cover 26 (FIG. 1) made of synthetic resin, for example, is provided on the head unit 4 from the front end to under the touch sensor 18 to cover the first and second red LEDs $\mathbf{20}R_{11}$, $\mathbf{20}R_{12}$, $\mathbf{20}R_{21}$ and $\mathbf{20}R_{22}$ and the blue-green LEDs $\mathbf{20}BG_1$ and $\mathbf{20}BG_2$.

Thereby, in the pet robot 1, when the first and second red LEDs $\mathbf{20}R_{11}$, $\mathbf{20}R_{12}$, $\mathbf{20}R_{21}$ and $\mathbf{20}R_{22}$ and the blue-green LEDs $\mathbf{20}BG_1$ and $\mathbf{20}BG_2$ are not lighted, they are not visible from outside, and on the contrary, when the first and second red LEDs 20$R_{11}$, 20$R_{12}$, 20$R_{21}$ and 20$R_{22}$ and the blue-green LED 20$BG_1$ and 20$BG_2$ are lighted, they are surely visible from outside, thus making it possible to effectively prevent strange emotion due to the three kinds of "eyes".

In addition to this structure, the LED section 20 of the pet robot 1 has a green LED 20G which is lighted when the system of the pet robot 1 is a specific state as described below.

This green LED 20G is an LED having a straight emitting part of a predetermined length, which can emit green light, and is arranged slightly over the first red LEDs 20$R_{11}$, 20$R_{12}$ on the head unit 4 and is also covered with the translucent cover 26.

As a result, in the pet robot 1, the user can easily recognize the system state of the pet robot 1, based on the lightening state of the green LED 20G which can be seen through the translucent cover 26.

(2) Processing by Controller 10

Next, the processing by the controller 10 of the pet robot 1 will be explained.

Figure 4:
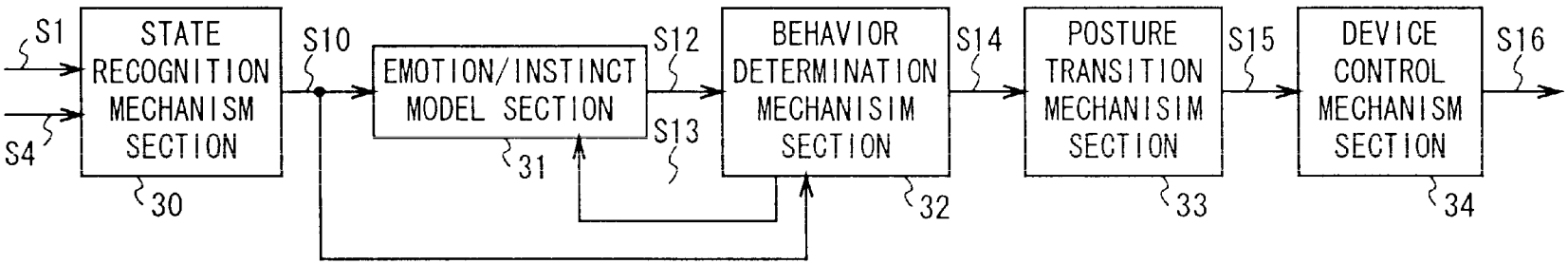
FIG. 4 is a block diagram explaining processing by a controller.

The contents of processing by the controller 10 are functionally divided into a state recognition mechanism section 30 for recognizing the external and internal states, a emotion/instinct model section 31 for determining the emotion and instinct states based on the recognition result from the state recognition mechanism section 30, a behavior determination mechanism section 32 for determining next action and behavior based on the recognition result from the state recognition mechanism section 30 and the outputs from the emotion/instinct model section 31, a posture transition mechanism section 33 for making a behavior plan for the pet robot to make the action and behavior determined by the behavior determination mechanism section 32, and a device control section 34 for controlling the actuators 21$_1$ to 21$_n$ based on the behavior plan made by the posture transition mechanism section 33, as shown in FIG. 4.

Hereinafter, these state recognition mechanism section 30, emotion/instinct model section 31, behavior determination mechanism section 32, posture transition mechanism section 33 and device control mechanism section 34 will be described in detail.

(2-1) Structure of State Recognition Mechanism Section 30

The state recognition mechanism section 30 recognizes the specific state based on the external information signal S1 given from the external sensor section 19 (FIG. 2) and the internal information signal S4 given from the internal sensor section 15, and gives the emotion/instinct model section 31 and behavior determination mechanism section 32 the recognition result as state recognition information S10.

In actual, the state recognition mechanism section 30 always checks the audio signal S1A which is given from the microphone 16 (FIG. 2) of the external sensor section 19, and when detecting that the spectrum of the audio signal S1A has the same scales as a command sound which is outputted from the sound commander for a command such as "walk", "lie down" or "chase a ball", recognizes that the command has been given and gives the recognition result to the emotion/instinct model section 31 and the behavior detection mechanism section 32.

Further, the state recognition mechanism section 30 always checks a video signal S1B which is given from the CCD camera 17 (FIG. 2), and when detecting "something red" or "a plane which is perpendicular to the ground and is higher than a predetermined height" in a picture based on the video signal S1B, recognizes that "there is a ball" or "there is a wall", and then gives the recognition result to the emotion/instinct model section 31 and the behavior determination mechanism section 32.

Furthermore, the state recognition mechanism section 30 always checks the pressure detection signal S1C which is given from the touch sensor 18 (FIG. 2), and when detecting pressure having a higher value than a predetermined threshold, for a short time (less than two seconds, for example), based on the pressure detection signal S1C, recognizes that "it was hit (scold)", and on the other hand, when detecting pressure having a lower value than a predetermined threshold, for a long time (two seconds or longer, for example), recognizes that "it was stroked (praised)". Then, the state recognition mechanism section 30 gives the recognition result to the emotion/instinct model section 31 and the behavior determination mechanism section 32.

Furthermore, the state recognition mechanism section 30 always checks the acceleration detection signal S4C which is given from the acceleration sensor 14 (FIG. 2) of the internal sensor section 15, and when detecting the acceleration having a higher level than a preset level, based on the acceleration detection signal S4C, recognizes that "it received a big shock", or when detecting the bigger acceleration like acceleration by gravitation, recognizes that "it fell down (from a desk or the like)". And then the state recognition mechanism section 30 gives the recognition result to the emotion/instinct model 31 and the behavior determination mechanism section 32.

Furthermore, the state recognition mechanism section 30 always checks the temperature detection signal S4B which is given from the thermal sensor 13 (FIG. 2), and when detecting a temperature higher than a predetermined level, based on the temperature detection signal S4B, recognizes that "internal temperature increased" and then gives the recognition result to the emotion/instinct model section 31 and the behavior determination mechanism section 32.

(2-2) Operation by Emotion/Instinct Model Section 31

Figure 5:
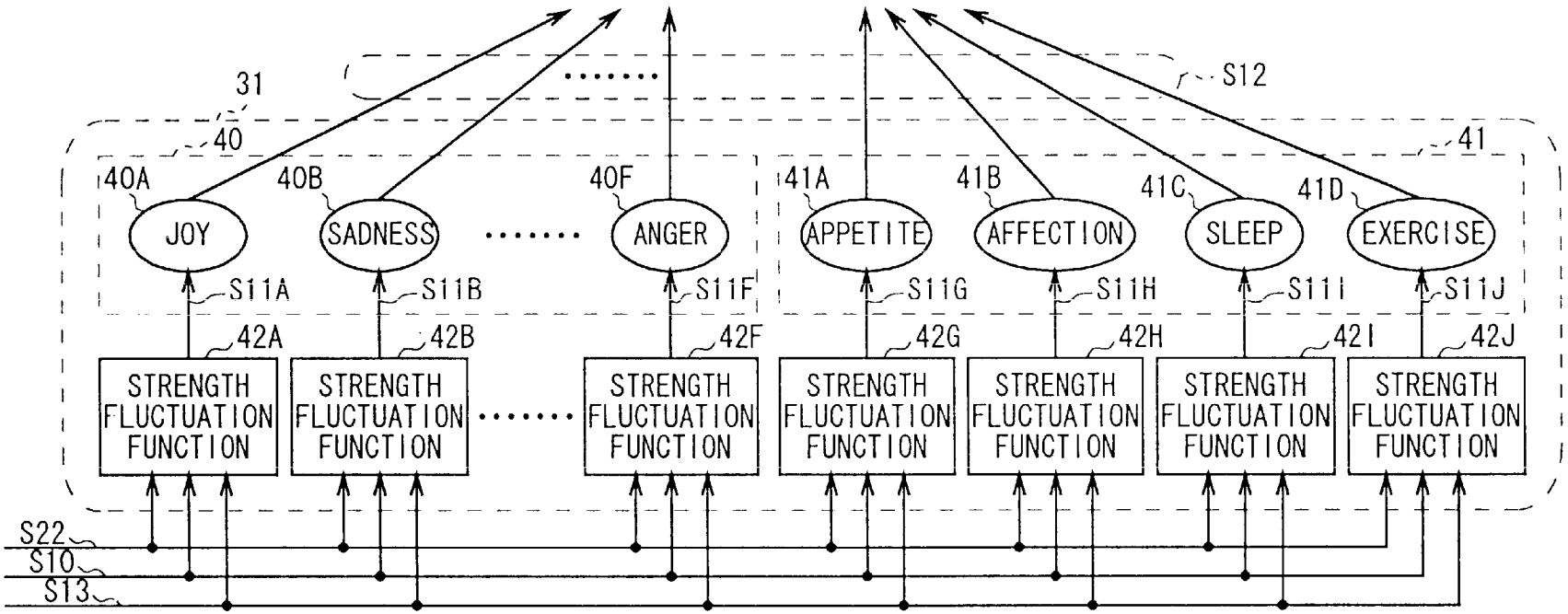
FIG. 5 is a conceptual diagram explaining data processing by a emotion/instinct model section.

The emotion/instinct model section 31, as shown in FIG. 5, has a group of basic emotions 40 composed of emotion units 40A to 40F as emotion models corresponding to six emotions of "joy", "sadness", "surprise", "horror", "hate" and "anger", a group of basic desires 41 composed of desire units 41A to 41D as desire models corresponding to four desires of "appetite", "affection", "sleep" and "exercise", and strength fluctuation functions 42A to 42J for the respective emotion units 40A to 40F and desire units 41A to 41D.

Each emotion unit 40A to 40F expresses the strength of corresponding emotion by its strength ranging from level zero to level one hundred, and changes the strength based on the strength information S11A to S11F which is given from the corresponding strength fluctuation function 42A to 42F time to time.

In addition, each desire unit 41A to 41D express the strength of corresponding desire by its strength ranging from level zero to level one hundred, and changes the strength based on the strength information S12G to S12J which is given from the corresponding strength fluctuation function 42G to 42J time to time.

Then, the emotion/instinct model section 31 determines the emotion by combining the strengths of these emotion units 40A to 40F, and also determines the instinct by combining the strengths of these desire units 41A to 41D and then outputs the determined emotion and instinct to the behavior determination mechanism section 32 as emotion/instinct information S12.

Note that, the strength fluctuation functions 42A to 42J are functions to generate and output the strength information S11A to S11J for increasing or decreasing the strengths of the emotion units 40A to 40F and the desire units 41A to 41D according to the preset parameters as described above, based on the state recognition information S10 which is given from the state recognition mechanism section 30 and the behavior information S13 indicating the current or past behavior of the pet robot 1 himself which is given from the behavior determination mechanism section 32 described later.

As a result, the pet robot 1 can have his characters such as "aggressive" or "shy" by setting the parameters of these strength fluctuation functions 42A to 42J to different values for respective action and behavior models (Baby 1, Child 2, Child 2, Young 1 to Young 3, Adult 1 to Adult 4).

(2-3) Operation by Behavior Determination Mechanism Section 32

The behavior determination mechanism section 32 has a plurality of behavior models in the memory 10A. The behavior determination mechanism section 32 determines next action and behavior based on the state recognition information 10 given from the state recognition mechanism section 30, the strengths of the emotion units 40A to 40F and desire units 41A to 41D of the emotion/instinct model section 31, and the corresponding behavior model, and then outputs the determination result as behavior determination information S14 to the posture transition mechanism section 33 and the growth control mechanism section 35.

Figure 6:
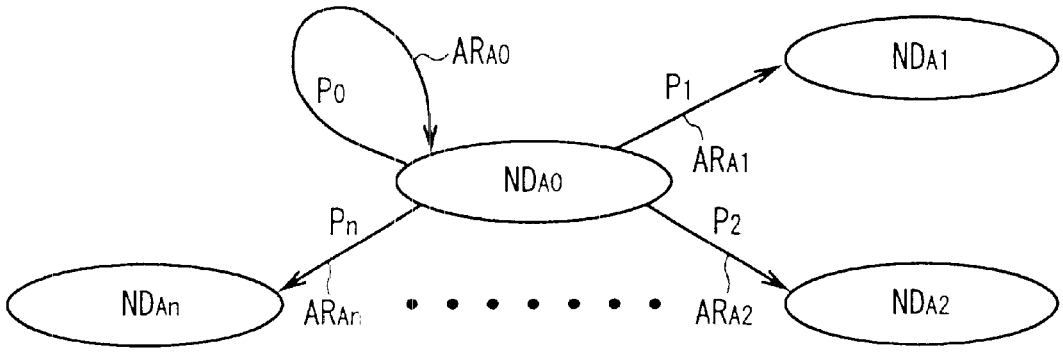
FIG. 6 is a conceptual diagram showing a probability automaton.

At this point, as a technique of determining next action and behavior, the behavior determination mechanism section 32 utilizes an algorithm called a probability automaton which probability determines whether transition is made from one node (state) $ND_{A0}$ to which node $ND_{A0}$ to $ND_{An}$, the same or another, based on transition probability $P_0$ to $P_n$ set for arc $AR_{A0}$ to $AR_{An}$ connecting between the nodes $ND_{A0}$ to $ND_{An}$, as shown in FIG. 6.

More specifically, the memory 10A stores a state transition table 50 as shown in FIG. 7 as behavior models for each node $ND_{A0}$ to $ND_{An}$, so that the behavior determination mechanism section 32 determines next action and behavior based on this state transition table 50.

In this state transition table 50, input events (recognition results) which are conditions for transition from a node $ND_{A0}$ to $ND_{An}$ are written in a priority order in a line of "input event name" and further conditions for transition are written in corresponding rows of "data name" and "data range" lines.

With respect to the node $ND_{100}$ defined in the state transition table 50 of FIG. 7, in the case where the recognition result of "detect a ball" is obtained, or in the case where the recognition result of "detect an obstacle" is obtained, a condition to make a transition to another node is what the recognition result also indicates that the "size" of the ball is "between 0 to 1000 (0, 1000)", or what the recognition result indicates that the "distance" to the obstacle is "between 0 to 100 (0, 100)".

In addition, if no recognition result is input, transition can be made from this node $ND_{100}$ to another node when the strength of any emotion unit 40A to 40F out of the "joy", "surprise" and "sadness" is "between 50 and 100 (50, 100), out of the strengths of the emotion units 40A to 40F and the desire units 41A to 41D which are periodically referred by the behavior determination mechanism section.

In addition, in the state transition table 50, node names to which a transition is made from the node $ND_{A0}$ to $ND_{An}$ are written in a "transition destination node" row of a "transition probability to another node" column, and transition probability to another node $ND_{A0}$ to $ND_{An}$ at which transition can be made when all conditions written in the "input event name", "data name" and "data limit" are fit, are written in an "output behavior" row of the "transition probability to another node" column. It should be noted that the sum of transition probability in each row of the "transition probability to another node" column is 100[%].

Thereby, with respect to this example of node $NODE_{100}$, in the case where "a ball (BALL) is detected" and the recognition result indicating that the "size" of the ball is "between 0 to 1000 (0, 1000) is obtained, a transition can be made to "node $NODE_{120}$ (node 120)" at probability of 30[%], and at this point, the action and behavior of "ACTION 1" are output.

Each behavior model is composed of the nodes $ND_{A0}$ to $ND_{An}$, which are written in such state transition table 50, each node connecting to others.

As described above, the behavior determination mechanism section 32, when receiving the state recognition information S10 from the state recognition mechanism section 30, or when a predetermined time passes after the last action is performed, probably determines next action and behavior (action and behavior written in the "output action" row) by referring to the state transition table 50 relating to the corresponding node $ND_{A0}$ to $ND_{An}$ of the corresponding behavior model stored in the memory 10A, and outputs the determination result as behavior command information S14 to the posture transition mechanism section 33 and the growth control mechanism section 35.

(2-4) Processing by Posture Transition Mechanism Section 33

The posture transition mechanism section 33, when receiving the behavior determination information S14 from the behavior determination mechanism section 32, makes a plan as to how to make the pet robot 1 perform the action and behavior based on the behavior determination information S14, and then gives the control mechanism section 34 behavior command information S15 based on the behavior plan.

Figure 8:
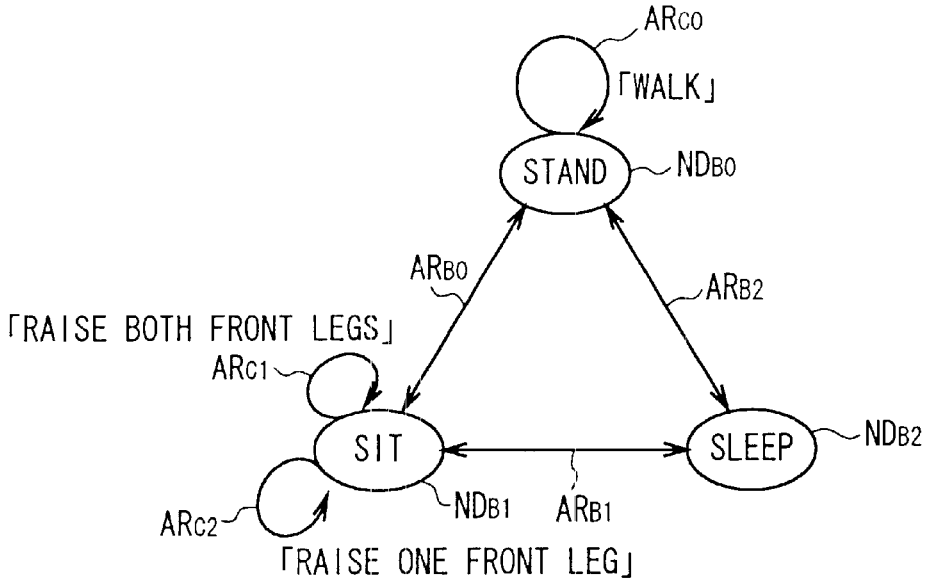
FIG. 8 is a conceptual diagram explaining a directed graph.

At this point, the posture transition mechanism section 33, as a technique to make a plan for behavior, utilizes a directed graph as shown in FIG. 8 in which postures the pet robot 1 can take are taken to as nodes $ND_{B0}$ to $ND_{B2}$, the nodes $ND_{B0}$ to $ND_{B2}$ between which the transition can be made are connected with directed arcs $AR_{B0}$ to $AR_{B3}$ indicating behavior, and behavior which can be done in one node $ND_{B0}$ to $ND_{B2}$ are expressed by own behavior arcs $AR_{C0}$ to $AR_{C2}$.

Therefore, the memory 10A stores data of a file which is an origin of such directed graph to show first postures and last postures of all behavior which can be made by the pet robot 1, in the form of a database (hereinafter, this file is referred to as a network definition file). The posture transition mechanism section 33 creates each directed graph 60 to 63 for the body unit, head unit, leg units, or tail unit as shown in FIG. 9 to FIG. 12, based on the network definition file.

Note that, as can be seen from FIG. 9 to FIG. 12, the postures are roughly classified into "stand (oStanding)", "sit (oSitting)", "lie down (Sleeping)" and "station (oStation)" which is a posture of sitting on a battery charger, not shown, to charge the battery 11 (FIG. 2). Each posture includes a base posture (double circles) which is common among the "growth states", and one or plural normal postures (single circle) for each "babyhood", "childhood", "younghood" and "adulthood".

Figure 9:
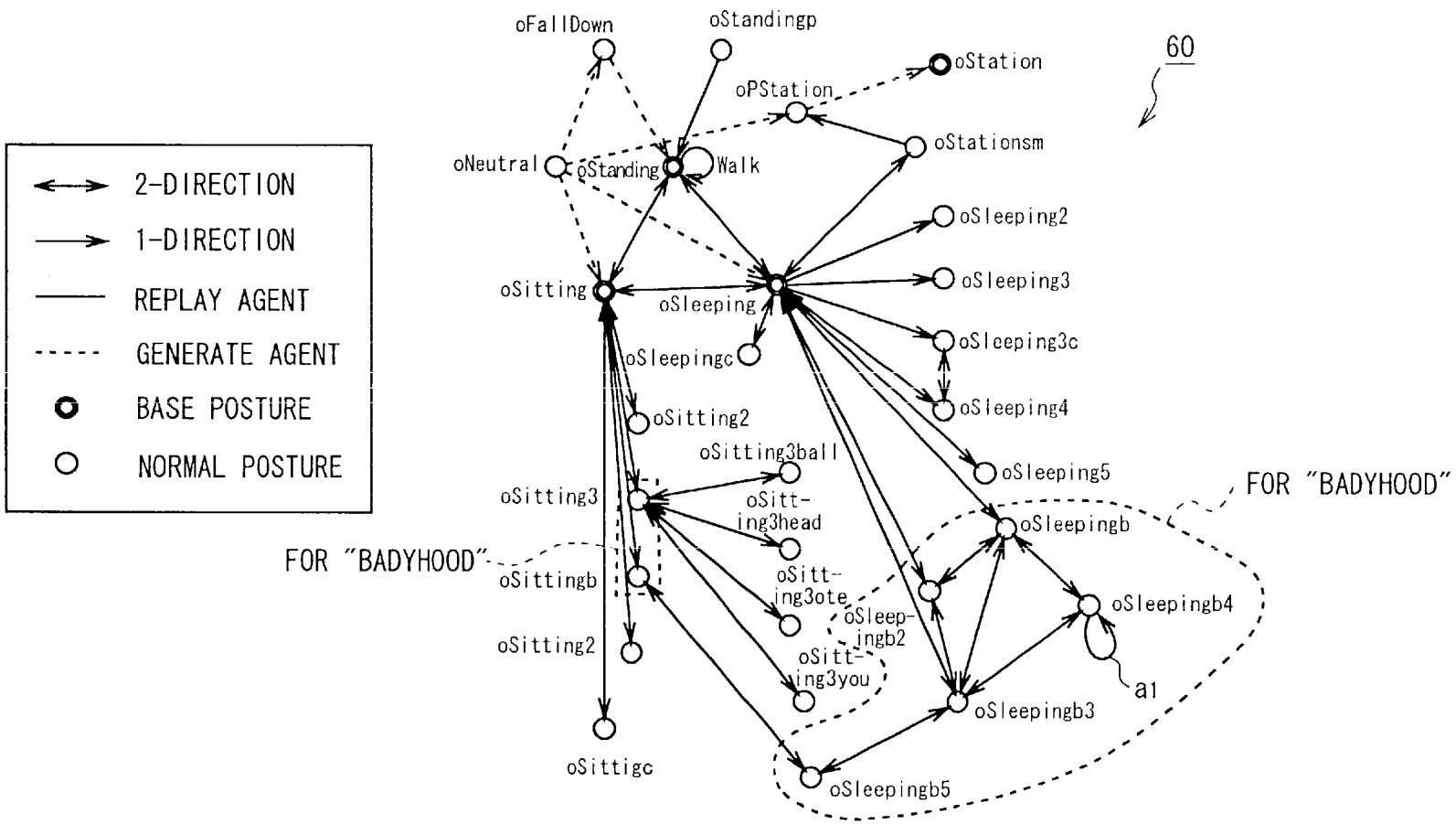
FIG. 9 is a conceptual diagram explaining a directed graph for the whole body.
Figure 10:
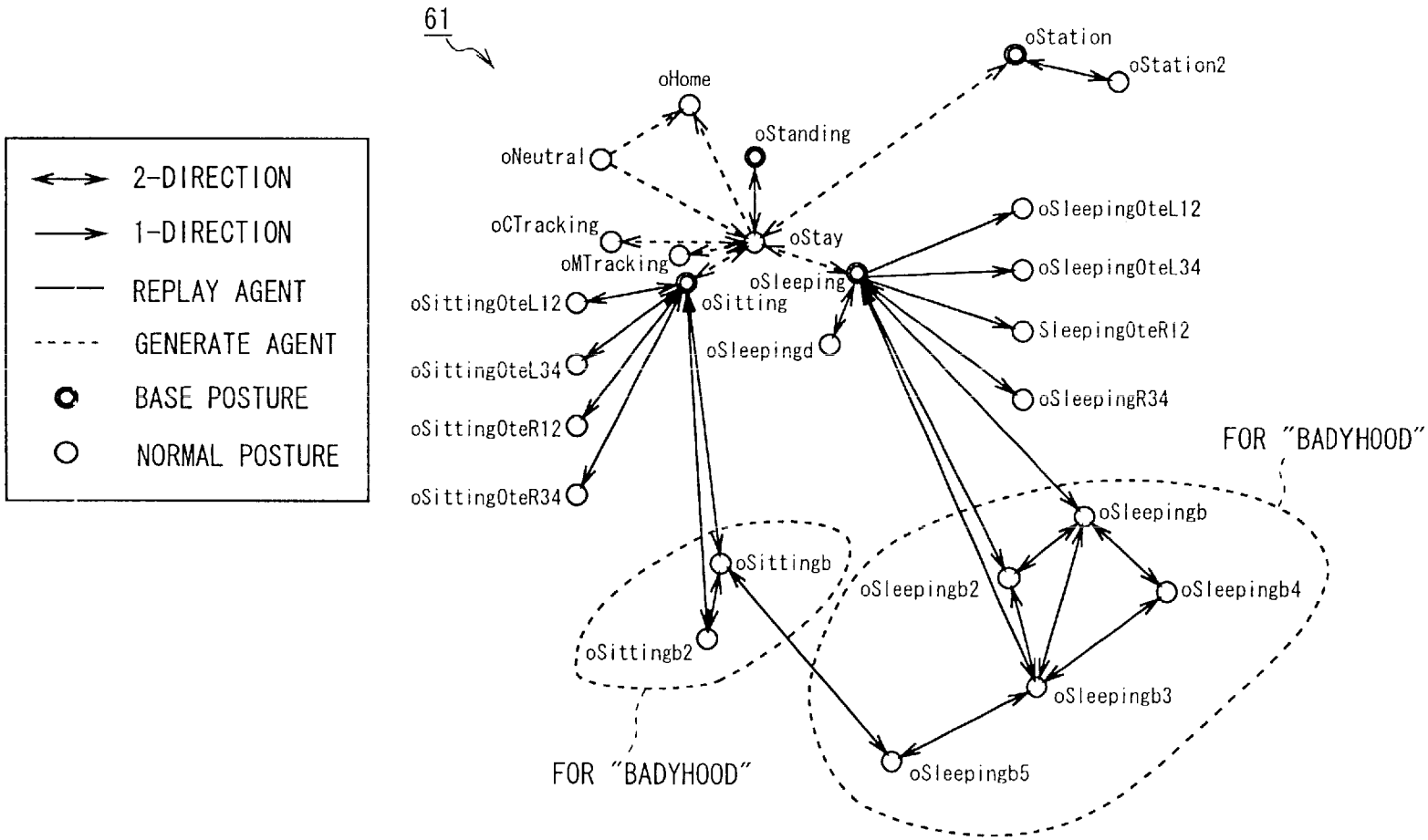
FIG. 10 is a conceptual diagram showing a directed graph for the head part.
Figure 11:
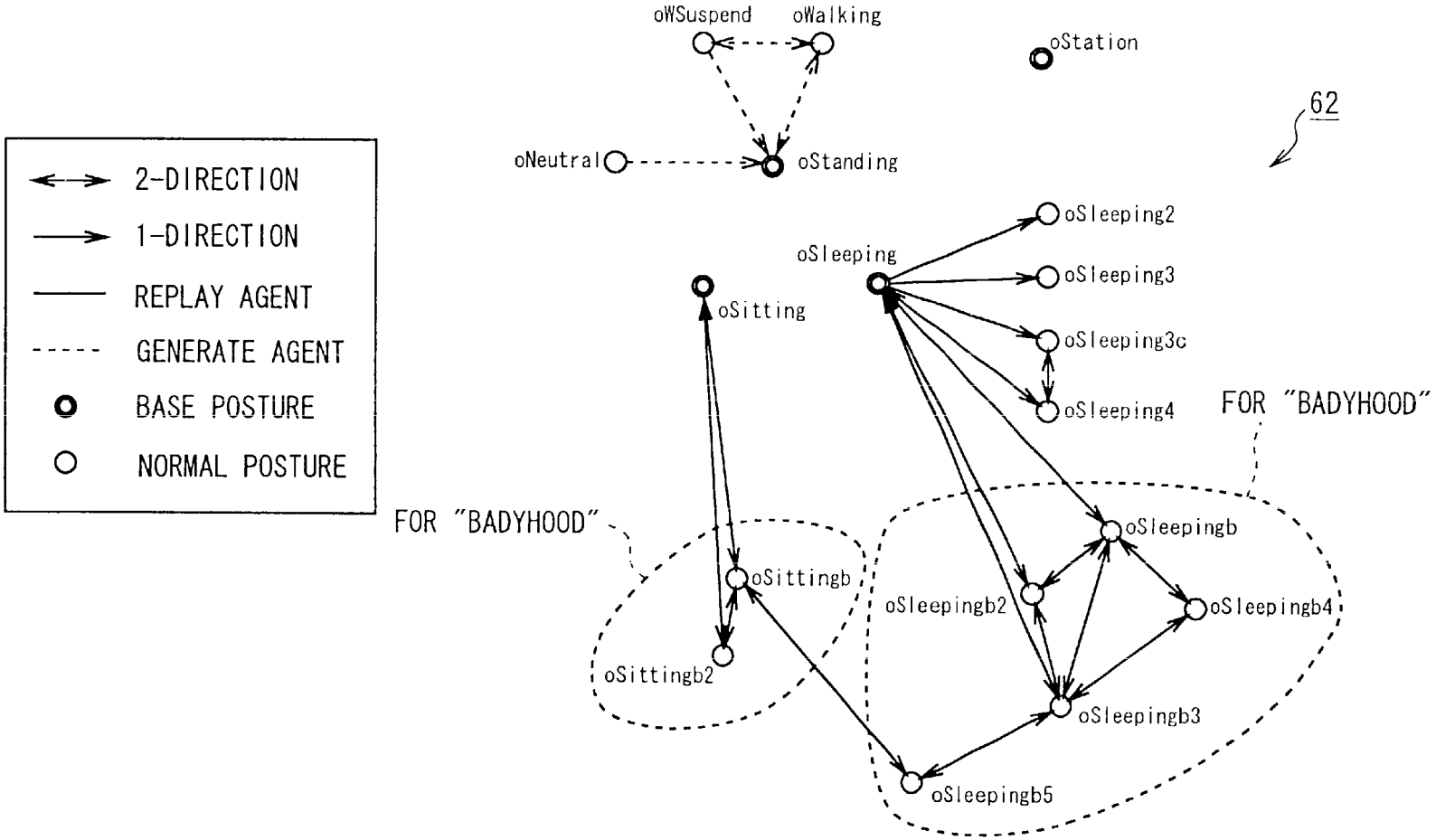
FIG. 11 is a conceptual diagram showing a directed graph for the leg parts.
Figure 12:
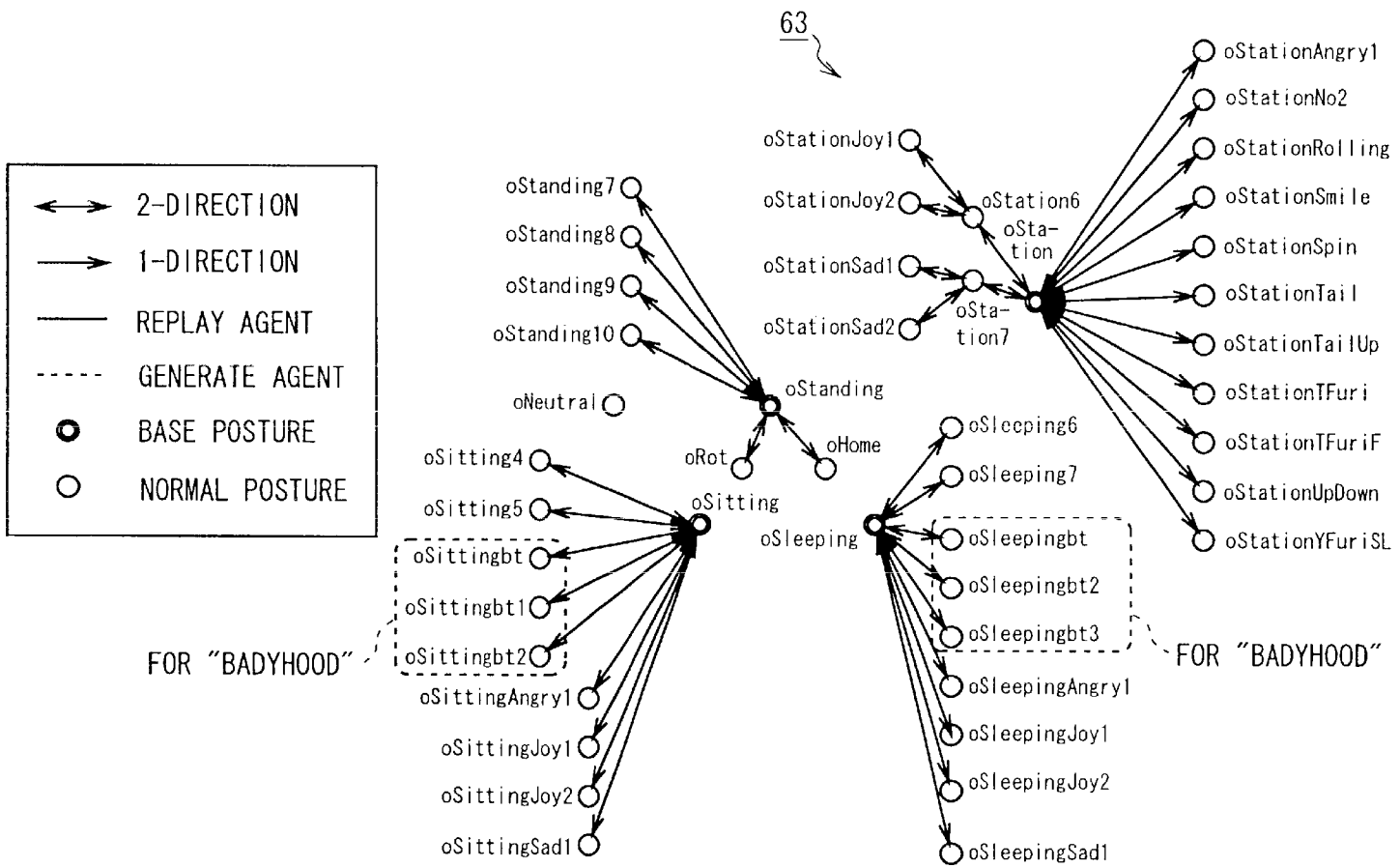
FIG. 12 is a conceptual diagram showing a directed graph for the tail part.

For example, parts enclosed by a dotted line in FIG. 9 to FIG. 12 show normal postures for "babyhood", and as can be seen from FIG. 9, the normal posture of "lie down" for "babyhood" includes "oSleeping b (baby)", "oSleeping b2" to "oSleeping b5" and the normal posture of "sit" includes "oSitting b" and "oSitting b2".

The posture transition mechanism section 33, when receiving a behavior command such as "stand up", "walk", "raise one front leg", "move head" or "move tail", as behavior command information S14 from the behavior determination mechanism section 32, searches for a path from the present node to a node corresponding to the designated posture, or to directed or own behavior arc corresponding to the designated behavior, following the directions of the directed arcs, and sequentially outputs behavior commands as behavior command information S15 to the control mechanism section 34 so as to sequentially output the behavior corresponding to the directed arcs on the searched path.

For example, when the present node of the pet robot 1 is "oSitting b" in the directed graph 60 for body and the behavior determination mechanism section 32 gives a behavior command for behavior (behavior corresponding to the own behavior arc $a_1$) which is made at the "oSleeping b4" node, to the posture transition mechanism section, the posture transition mechanism section 33 searches for a path from the "oSitting b" to the "oSleeping b4" in the directed graph 60 for body, and sequentially outputs a behavior command for changing the posture from the "oSitting b" node to the "oSleeping b5" node, a behavior command for changing the posture from the "oSleeping b5" node to the "oSleeping b3" node, and a behavior command for changing the posture from the "oSleeping b3" node to the "oSleeping b4" node, and finally outputs a behavior command for returning to the "oSleeping b4" node from the "oSleeping b4" node through the own behavior arc $a_1$ corresponding to the designated behavior, as behavior command information S15 to the control mechanism section 34.

At this point, a plurality of arcs may connect two transmittable nodes to change behavior ("aggressive" behavior, "shy" behavior etc.) according to the "growth stage" and "characters" of the pet robot 1. In such case, the posture transition mechanism section 33 selects directed arcs suitable for the "growth stage" and "characters" of the pet robot 1 under the control of growth control mechanism section 35 described later, as a path.

Similarly to this, a plurality of own behavior arcs may be provided to return from a node to the same node, to change behavior according to the "growth stage" and "characters". In such case, the posture transition mechanism section 33 selects directed arcs suitable for the "growth stage" and "characters" of the pet robot 1 as a path, similar to the aforementioned case.

In the aforementioned posture transition, since postures passed on the path do not need to be taken, nodes used at another "growth step" can be passed in the middle of the posture transition. Therefore, when the posture transition mechanism section 33 searches for a path from the present node to a targeted node, or to a directed arc or an own behavior arc, it searches for the shortest path, without regard to the present "growth step".

Further, the posture transition mechanism section 33, when receiving a behavior command for head, legs or tail, returns the posture of the pet robot 1 to a base posture (indicated by double circles) corresponding to the behavior command based on the directed graph 60 for body, and then outputs behavior command information S15 so as to transit the position of head, legs or tail using the corresponding directed graph 61 to 63 for head, legs or tail.

(2-5) Processing by Device Control Mechanism Section 34

The control mechanism section 34 generates a control signal S16 based on the behavior command information S15 which is given from the posture transition mechanism section 33, and drives and controls each actuators $\mathbf{21}_1$ to $\mathbf{21}_n$ based on the control signal S16, to make the pet robot 1 perform a designated action and behavior.

(3) Photographing Processing Procedure RT1

Figure 13:
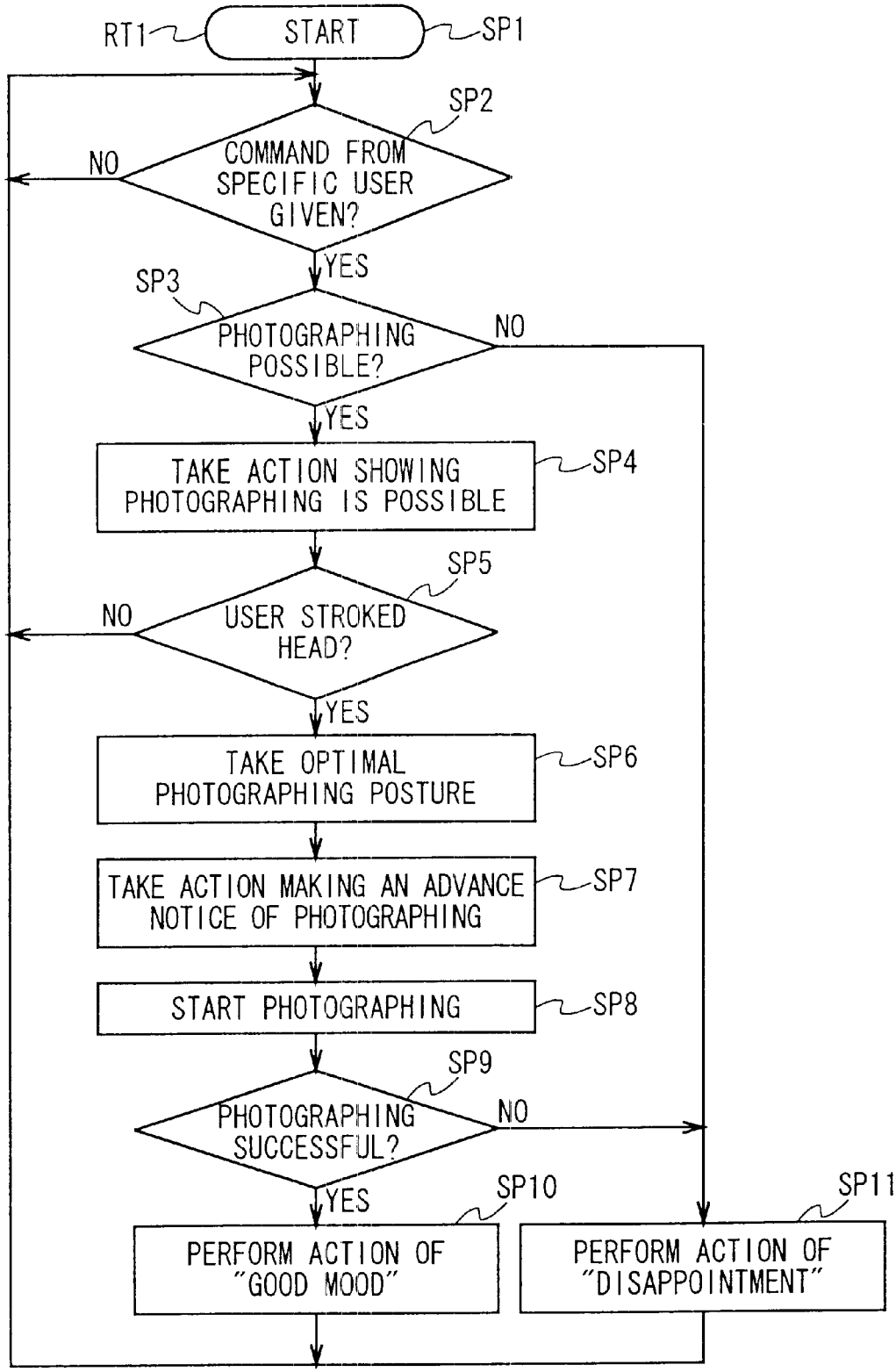
FIG. 13 is a flowchart showing a processing procedure for taking a picture.
Figure 14:
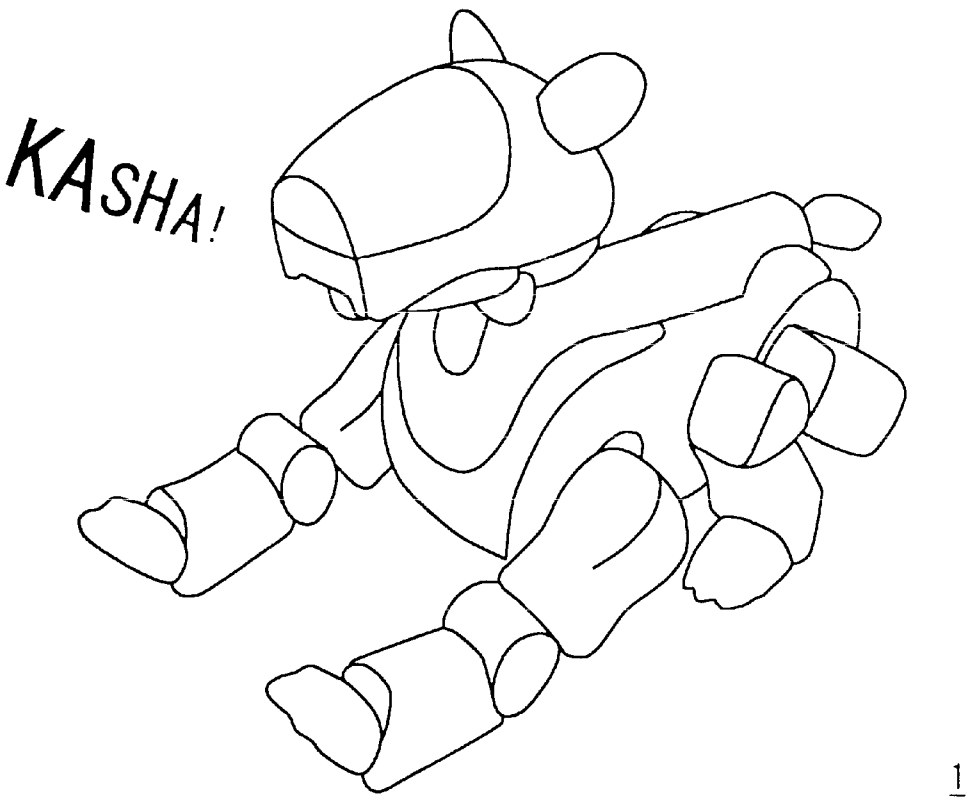
FIG. 14 is a schematic diagram explaining the state where a shutter-releasing sound is output.

The controller 10 takes a picture based on the user instructions according to the photographing processing procedure RT1 shown in FIG. 13, protecting the user's privacy.

That is, when the controller 10 collects sounds of language "take a picture", for example, which is given from the user, via the microphone 16, it starts the photographing processing procedure RT1 at step SP1, and at following step SP2, performs audio recognition processing which is voice judgement processing and content analysis processing, using the audio processing section, on that language, which was collected via the microphone 16, to judge whether it has received a photographing command from the user.

Specifically, the controller 10 previously stores the voice-print of a specific user into the memory 10A, and the audio processing section performs voice judgement processing by comparing the voice-print of the language collected via the microphone 16 to the voice-print of the specific user stored in the memory 10A. In addition, the controller 10 previously stores language and grammar which are used with high possibility to make the pet robot 1 act and behavior, in the memory 10A, and the audio processing section performs the content analysis processing on the collected language by analyzing the language collected via the microphone 16, every word, and then referring to the corresponding language and grammar read out from the memory 10A.

In this case, the user who set a flag for indicating whether to make the photographing function active or not, in the external memory 25, previously stores his/her own voice-print in the memory 10A of the controller 10 so as to recognize it in the actual audio recognition processing. Therefore, the specific user puts up/down the flag sets in the external memory 25 with his/her own personal computer (not shown), to allow data to/not to be written in the external memory.

The controller 10 waits for an affirmative result to be obtained at step SP2, that is, waits for an audio recognition processing result representing that the collected language is identical to the language given from the specific user, to be obtained, and then proceeds to step SP3 to judge whether the photographing is set to be possible, based on the flag set in the external memory 25.

If an affirmative result is obtained at step SP3, it means that the photographing is set to be possible at present, then the controller 10 proceeds to step SP4 to move the head unit 4 up and down to make behavior of "nodding", starts to count time with a timer not shown at the start time of "nodding" behavior, and then proceeds to step SP5.

On the other hand, if a negative result is obtained at step SP3, it means that the photographing is set to be impossible at present, then the controller 10 proceeds to step SP11 to perform behavior of, for example, "disappointment" as if it feels sad with the head down, then returns to step SP2 to wait for the photographing instruction from the specific user.

Then, at step SP5, the controller 10 judges based on the counting result of the timer and the sensor outputs of the touch sensor 18 whether the user stroked the head within preset time of duration (within one minute, for example), and if an affirmative result is obtained, it means the user wants to start photographing. In this case, the controller 10 proceeds to step SP6 to take a posture with the front legs bending and with the head facing slightly upward (hereinafter, this posture is referred to as an optimal photographing posture), for example, so as to focus the photographing range of the CCD camera 17 on the subject with preventing the CCD camera 17 in the head unit from shaking.

On the other hand, if a negative result is obtained at step SP5, it means that the user does not want to take a photo within the preset time of duration (for example, within one minute), then the controller 10 returns to step SP2 again to wait for the photographing command to be given from the specific user.

Then, the controller 10 proceeds to step SP7 to sequentially put off the first and second red LEDs 20$R_{11}$, 20$R_{12}$, 20$R_{21}$ and 20$R_{22}$ and the blue-green LED 20$BG_1$, 20$BG_2$ of the LED section 20, which are arranged at the apparent "eyes" positions of the head unit 4, one by one clockwise, starting with the second red LED 20$R_{12}$, and putting off the last first red LED 20$R_1$, informs the user that a picture is taken very soon.

In this case, as the LEDs 20$R_{11}$, 20$R_{12}$, 20$R_{21}$, 20$R_{22}$, 20$BG_1$ and 20$BG_2$ of the LED section 20 are sequentially put off, warning sounds of "pipipi . . . " is output faster and faster from the loudspeaker 21 and the mental state display LED 5AL of the tail unit 5 is blinked in blue in synchronous with the warning sounds.

Sequentially, the controller 10 proceeds to step SP8 to take a picture with the CCD camera 17 at predetermined timing just after the last first red LED 20$R_1$, is put off. At this point, the mental state display LED 5AL of the tail unit 5 is strongly lighted in orange at one moment. In addition, when a picture is taken (when the shutter is released), an artificial photographing sound of "KASHA!" may be output, so that it can be recognized that a photo was taken, in addition to a reason of avoiding stealthy photographing.

Then, at step SP9, the controller 10 judges whether the photographing with the CCD camera 17 was successful, that is whether the video signal S3 taken in via the CCD camera 17 could be stored in the external memory 25.

If an affirmative result is obtained at step SP9, it means that the photographing was successful, then the controller 10 proceeds to step SP10 to make behavior of "good mood" by raising both front legs, then returns to step SP2 to wait for the photographing command from the specific user.

On the contrary, if a negative result is obtained at step SP9, it means that the photographing was failed due to a shortage of capacity of the file in the external memory 25 or due to errors in writing, for example. In this case, the controller 10 proceeds to step SP11 and performs behavior of "disappointment" as if it feels sorry with the head part turning down, and then return to step SP2 to wait for the specific user to make a photographing command.

As described, the pet robot 1 can take a picture, confirming the specific user's intentions for photographing start, in response to the photographing command from the user.

In this connection, the user who was identified through the aforementioned audio recognition processing can read out image based on picture data from the external memory 25 removed from the pet robot 1, by means of the own personal computer to display it on the monitor, and also can delete the picture data read out from the external memory 25.

Figure 15:
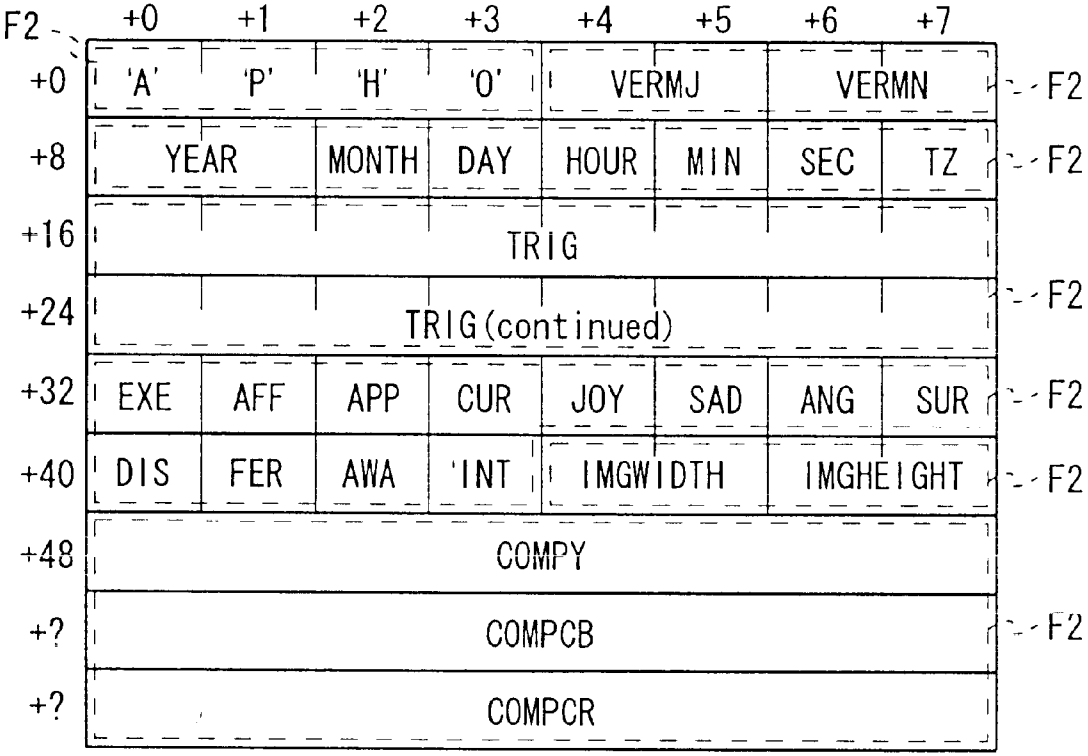
FIG. 15 is a table explaining the contents of a binary file stored in an external memory.

In actual, the picture data which is obtained as the photographing result is stored in the external memory 25 as a binary file (Binary File) including the photographing date, trigger information (information about a reason for photographing), and a emotion level. This binary file BF includes a file magic field F1, a version field F2, a field for photographing time F3, a field for trigger information F4, a field for emotion level F5, a header of picture data F6 and an picture data field F7, as shown in FIG. 15.

Written in the file magic field Fl are ASCII letters comprising "A", "P", "H", and "T" each composed of a code of seven bits. Written in the version field F2 are a major version area "VERMJ" and a minor version area "VERMN" each of which the value is set to a value between 0 to 65535.

Further, written in the field F3 for photographing time are sequentially "YEAR" indicating year information of the photographing date, "MONTH" indicating month information, "DAY" indicating date information, "HOUR" indicating hour information, "MIN" indicating minute information, "SEC" indicating second information, and "TZ" indicating time information which represents time offset to the world standard time with the British Greenwich as a standard. The field for trigger information F4 contains 16-byte data at most to indicate trigger information "TRIG" which represents a trigger condition for photographing.

Furthermore, written in the field for emotion level F5 are sequentially "EXE" indicating the strength of "desire for exercise" at photographing, "AFF" indicating the strength of "affection" at photographing, "APP" indicating the strength of "appetite" at photographing, "CUR" indicating the strength of "curiosity" at photographing, "JOY" indicating the strength of "joy" at photographing, "ANG" indicating the strength of "anger" at photographing, "SAD" indicating the strength of "sadness" at photographing, "SUR" indicating the strength of "surprise" at photographing, "DIS" indicating the strength of "disgust" at photographing, "FER" indicating the strength of "fear" at photographing, "AWA" indicating the strength of "awakening level" at photographing, and "INT" indicating the strength of "interaction level" at photographing.

Still further, written in the picture data header F6 are pixel information "IMGWIDTH" which indicates the number of pixels in the width direction of an image and pixel information "IMGHEIGHT" which indicates the number of pixels in the height direction of an image. Still further, written in the picture data field F7 are "COMPY" which is data indicating the luminance component of an image, "COMPCB" which is data-indicating the color difference component Cb of an image, and "COMPCR" which is data indicating the color difference component Cr of an image, and these data are set to a value between 0 to 255, using one byte for one pixel.

(4) Operation and Effects of this Embodiment

Under the aforementioned structure, when the pet robot 1 collects language "take a picture" given from a user, it performs the audio recognition processing on the language through the voice-print judgement and content analysis. As a result, if this user is a specific user which should be identified and made a photographing command, the pet robot 1 waits for the user to make a photographing start order, on the condition in which the photographing function is set to be active.

Thereby, the pet robot 1 can ignore the photographing order from an unspecific user who is not allowed to make a photographing order, and also can avoid erroneous operation of the user in advance by making the user, who has been allowed to make a photographing order, confirm once more whether he/she wants to take a picture.

Then, when the user makes the photographing start order, the pet robot 1 takes the optimal photographing posture, so that the CCD camera 17 can be prevented from shaking at photographing and also the user who is a subject is set to be within the photographing area of the CCD camera 17.

Then, the pet robot 1 puts off the 20$R_{11}$, 20$R_{12}$, 20$R_{21}$, 20$BG_1$, 20$BR_2$ of the LED section 20 arranged at the apparent "eye" positions on the head unit, one by one clockwise at predetermined timing, with keeping this optimal photographing posture, which shows a countdown for taking a picture, to the user which is a subject. This LED section 20 is arranged close to the CCD camera 17, so that the user, as a subject, can confirm the putting-off operation of the LED section 20, while watching the CCD camera 17.

At this time, with the aforementioned putting-off operation of the LED section 20, the pet robot 1 outputs warning sounds via the loudspeaker 21 in synchronization with blinking timing while blinking the mental state display LED 5AL of the tail unit 5 in a predetermined lightening pattern. As the putting-off operation of the LED section 20 is close to end, the interval of the warning sounds outputted from the loudspeaker 21 becomes shorter and the blinking speed of the mental state display LED section 5AL becomes faster, thereby not only watching but also listening makes the user confirm the end of the countdown which indicates that a picture is taken now. As a result, further impressive confirmation can be made.

Then, the pet robot 1 puts on the mental state display LED 5AL of the tail unit 5 in orange at one moment, in synchronization with the end of putting-off operation of the LED section 20 and the same time, takes a picture with the CCD camera 17, thereby the user can know the moment of photographing.

After that, the pet robot 1 judges whether the image as a result of the photographing with the CCD camera 17 could be stored in the external memory 25 to judge whether the photographing was successful, and when successful, performs behavior of "good mood", and on the other hand, performs behavior of "disappointment" when failed, thereby the user can easily recognize whether the photographing was successful or failed.

Further, the picture data obtained by photographing is stored in the removable external memory 25 inserted into the pet robot 1, and the user can arbitrary delete the picture data stored in the external memory 25 with his/her own personal computer, thereby the picture data indicating data which must not been seen by anybody can be deleted before the user has it repaired, gives it, or lends it. As a result, the user's privacy can be protected.

According to the above structure, when the pet robot 1 receives a photographing start order from a user who is allowed to make a photographing order, it takes an optimal photographing posture to catch the user within the photographing area, and shows the user who is a subject, a countdown until photographing time by putting off the LED section 20 arranged at the apparent "eye" positions of the head unit 4, at predetermined timing before the photographing start, thereby the user can recognize that a photo will be taken soon in real time. As a result, a photo can be prevented from being taken by stealth, regardless of user's intention, to protect the user's privacy. Thereby, the pet robot 1 leaves scenes which the pet robot 1 used to see, memory scenes of grown-up environments as images, thereby the user can feel more satisfied and familiar, thus making it possible to realize a pet robot which can offer further improved entertainment property.

Further, according to the aforementioned structure, when the LED section 20 is put off before the photographing, the mental state display LED 5AL is blinked in such a manner that the blinking speed gets faster as the putting-off operation of the LED section 20 gets close to end, and at the same time, warning sounds are output from the loudspeaker 21 in such a manner that the interval of sounds gets shorter, thereby the user can recognize the end of the countdown for photographing with emphasize, thus making it possible to realize a pet robot which can improve the entertainment property.

(5) Other Embodiments

Note that, in the aforementioned embodiment, the present invention is applied to a four legged walking pet robot 1 produced as shown in FIG. 1. The present invention, however, is not limited to this and can be widely applied to other types of pet robots.

Further, in the aforementioned embodiment, the CCD camera 17 provided on the head unit 4 of the pet robot 1 is applied as a photographing means for photographing subjects. The present invention, however, is not limited to this and can be widely applied to other kinds of photographing means such as video camera and still camera.

In this case, a smooth filter can be applied to luminance data of an image at a level according to the "awakening level" at the video processing section 24 (FIG. 2) of the body unit 2 so that the image is out of focus when the "awakening level" of the pet robot 1 at photographing is low, and as a result, the "caprice level" of the pet robot 1 can be applied to this image, thus making it possible to offer further improved entertainment property.

Further, in the aforementioned embodiment, the LED section 20 functioning as "eyes", also in appearance, the loudspeaker 21 functioning as "mouth", and the mental state display LED 5AL provided on the tail unit 5 are applied as a notifying means for making an advance notice of photographing with the CCD camera (photographing means) 17. The present invention, however, is not limited to this and various kinds of notifying means, in addition to or other than this, can be utilized as notifying means. For example, the advance notice of photographing can be expressed via the various behaviors using all legs, head, and tail of the pet robot 1.

Furthermore, in the aforementioned embodiment, the controller 10 for controlling the whole operation of the pet robot 1 is provided as a control means for blinking the first and second red LEDs 20$R_{11}$, 20$R_{12}$, 20$R_{21}$, and 20$R_{22}$ and the blue-green LEDs 20$BG_1$ and 20$BG_2$, and the mental state display LED 5AL. The present invention, however, is not limited to this and the control means for controlling the blink of the lightening means can be provided separately from the controller 10.

Furthermore, in the aforementioned embodiment, the first and second red LEDs 20$R_{11}$, 20$R_{12}$, 20$R_{21}$, and 20$R_{22}$ and the blue-green LEDs 20$BG_1$ and 20$BG_2$ of the LED section 20 functioning as "eyes" in appearance are sequentially put off in turn under control. The present invention, however, is not limited to this and lightning can be performed at another lightning timing in another lightning pattern as long as a user can recognize the advance notice of photographing.

Furthermore, in the aforementioned embodiment, the blinking interval of the mental state display LED 5AL arranged at the tail in appearance gradually gets shorter under control. The present invention, however, is not limited to this and lightning can be performed in another lightening pattern as long as the user can recognize the advance notice of photographing.

Furthermore, in the aforementioned embodiment, the controller 10 for controlling the whole operation of the pet robot 1 is provided as a control means for controlling the loudspeaker (warning sound generating means) 21 so that the interval of warning sounds as an advance notice of photographing becomes shorter. The present invention, however, is not limited to this and a control means for controlling the warning sound generating means can be provided separately from the controller 10.

INDUSTRIAL UTILIZATION

The robot apparatus and control method for the same can be applied to amusement robots and care robots.

What is claimed is:

1. A robot apparatus comprising:

recognition processing means for comparing pre-recorded data with current user data to perform content analysis to determine whether a user of said robot apparatus is permitted to operate a photographing capability;

photographing means for taking a picture of subjects; and notifying means for making an advance notice of photographing with said photographing means.

2. The robot apparatus according to claim 1, wherein said notifying means comprises:

lightening means for emitting light; and control means for controlling blinking of said lightening means as the advance notice of photographing.

3. The robot apparatus according to claim 1, wherein said notifying means comprises:

warning sound generating means for generating warning sounds; and control means for controlling said warning sound generating means so that intervals of warning sounds are gradually shortened as the advance notice of photographing.

4. A robot apparatus comprising:

photographing means for taking a picture of subjects;

notifying means for making an advance notice of photographing with said photographing means; and lightening means for emitting light, wherein:

said lightening means comprises a plurality of lightening parts which function as eyes in appearance; and control means for controlling blinking of said lightening means as the advance notice of photographing.

5. A robot apparatus comprising:

photographing means for taking a picture of subjects;

notifying means for making an advance notice of photographing with said photographing means;

lightening means for emitting light; wherein said lightening means comprises a lightening part arranged on a tail in appearance; and control means for controlling blinking of said lightening means as the advance notice of photographing; wherein said control means controls said lightening part so as to gradually shorten a blinking interval as the advance notice of photographing.

6. A robot apparatus which behaves autonomously, comprising:

recognition processing means for comparing pre-recorded data with current user data to perform content analysis to determine whether a user of said robot apparatus is permitted to operate a photographing capability;

photographing means for taking a picture of subjects; and sound output means, wherein artificial photographing sounds are output from said sound output means when the subjects are to be taken.

7. A control method for a robot apparatus comprising the steps of:

comparing pre-recorded data with current user data to perform content analysis to determine whether a user of said robot apparatus is permitted to operate a photographing capability;

making an advance notice of photographing of subjects: and photographing the subjects.

8. The control method for the robot apparatus according to claim 7, further comprising the step of:

controlling blinking of lightening as the advance notice of photographing.

9. A control method for a robot apparatus comprising the steps of:

making an advance notice of photographing of subjects;

photographing the subjects; and controlling blinking of lightening parts as the advance notice of photographing;

wherein said lightening parts function as eyes in appearance and are controlled so as to be put off in turn as the advance notice of photographing.

10. A control method for a robot apparatus comprising the steps of:

making an advance notice of photographing of subjects;

photographing the subjects; and controlling blinking of a lightening part as the advance notice of photographing;

wherein said lightening part is arranged on a tail in appearance and is controlled so that a blinking interval is shortened as the advance notice of photographing.

11. The control method for the robot apparatus according to claim 7, further comprising the step of:

generating warning sounds so as to shorten the interval of warning sounds as the advance notice of photographing.

12. A control method for a robot apparatus comprising the steps of:

comparing pre-recorded data with current user data to perform content analysis to determine whether a user of said robot apparatus is permitted to operate a photographing capability;

making an advance notice of photographing of subjects; and photographing the subjects; wherein artificial photographing sounds are output when subjects are taken.

13. A robot apparatus which has a plurality of movable parts, comprising:

photographing means for taking a picture of subjects; and memory means for storing the picture which is taken by the photographing means, wherein the robot apparatus performs a motion expressing the success of taking the picture with the movable parts when the picture can be stored in the memory means, or the robot apparatus performs a motion expressing the failure of taking the picture with the movable parts when the picture cannot be stored into the memory means.

* * * * *